United States Patent [19]

Caroulle

[11] Patent Number: 4,772,154

[45] Date of Patent: Sep. 20, 1988

[54] SEALING GASKET FOR A ROADWAY MANHOLE

[75] Inventor: Didier Caroulle, Nomeny, France

[73] Assignee: Pont-A-Mousson S.A., Nancy, France

[21] Appl. No.: 93,269

[22] Filed: Sep. 4, 1987

[30] Foreign Application Priority Data

Sep. 5, 1986 [FR] France ..... 86 12589

[51] Int. Cl.[4] ..... E02D 29/14

[52] U.S. Cl. ..... 404/25; 277/207 A; 285/110; 52/20

[58] Field of Search ..... 404/25, 26; 277/207 A; 285/110, 111, 379; 52/19–21

[56] References Cited

U.S. PATENT DOCUMENTS

| | | | |
|---|---|---|---|
| 2,882,073 | 4/1959 | James | 277/207 A |
| 2,980,449 | 4/1961 | Dunton | 277/207 A |
| 3,015,510 | 1/1962 | Bates | 277/207 A |
| 3,046,028 | 7/1962 | Nathan | 277/207 A |
| 3,081,102 | 3/1963 | Murray et al. | 277/207 A |
| 3,573,871 | 4/1971 | Warner | 285/110 X |
| 4,648,740 | 3/1987 | Carlson | 404/25 |

FOREIGN PATENT DOCUMENTS 2825303 12/1979 Fed. Rep. of Germany .

*Primary Examiner*—Jerome Massie
*Assistant Examiner*—John F. Letchford
*Attorney, Agent, or Firm*—Sughrue, Mion, Zinn, Macpeak and Seas

[57] ABSTRACT

A sealing gasket for an unlocked roadway manhole accessing a municipal sewage system is interposed between a cover 2 and a frame 1, and has an inverted L or hook-shaped cross-section including two spaced and parallel outwardly extending upper lips 18, 19 and two lower, oppositely extending lips 17, 20.

7 Claims, 1 Drawing Sheet

SEALING GASKET FOR A ROADWAY MANHOLE

BACKGROUND OF THE INVENTION

This invention relates to a sealing gasket adapted to be interposed between the cover and the frame of a roadway manhole accessing an underground system, particularly a municipal sewage disposal system.

Local ordinances frequently require that roadway manholes accessing sewage disposal systems be sealed to prevent rain water or the like from trickling into the system and thus overloading sewage treatment stations. One approach has been to interpose a simple, sufficiently flexible gasket, for example made of an elastomer having a hardness of between 45° Shore and 60° Shore, between the cover and the frame of the manhole so that it fits snugly against their rough cast surfaces. If the cover is not locked to the frame, however, for example by appropriate edge clamps or a bayonet coupling, the movements of the cover within the frame tend to shear the gasket and thus disrupt its sealing effect. This problem may be offset or at least partially overcome by making the gasket from a harder elastomer on the order of 70° Shore to 80° Shore, but such increased hardness detracts from its sealing effect.

Another approach is to lock the cover to the frame to prevent it from moving, thus reducing the shearing effect on the gasket. For example, U.S. Pat. No. 4,203,686 teaches a roadway manhole in which the cover is held in the frame by a locking ring laid against the upper surface of the cover and having bearing surfaces located opposite corresponding surfaces of the frame. The gasket is interposed between the frame and the cover, and is compressed when the ring is rotated to lock the cover to the frame. Such a construction requires a costly and difficult to fabricate locking mechanism, however, and moreover the frictional forces between the various components are often insufficient to prevent the cover from rotating and thus abrading the gasket upon the passage of a vehicle.

SUMMARY OF THE INVENTION

The present invention is intended to overcome these problems by providing a gasket for an unlocked roadway manhole which establishes and maintains a sufficient seal to prevent the entry of rain water and which withstands the shearing movements of the unlocked cover relative to the frame. More specifically, the gasket, when viewed in cross-section, has a vertical branch extended at its upper end by an outwardly radial horizontal branch which is interposed between facing or bearing surfaces of the cover and the frame. The upper surface of the horizontal branch is provided with two spaced, frustoconical lips converging towards the base of the gasket, and a pair of oppositely extending lips are also preferably provided at the lower end of the vertical branch of the gasket.

DETAILED DESCRIPTION OF THE PREFERRED EMBODIMENT

Figure 1:
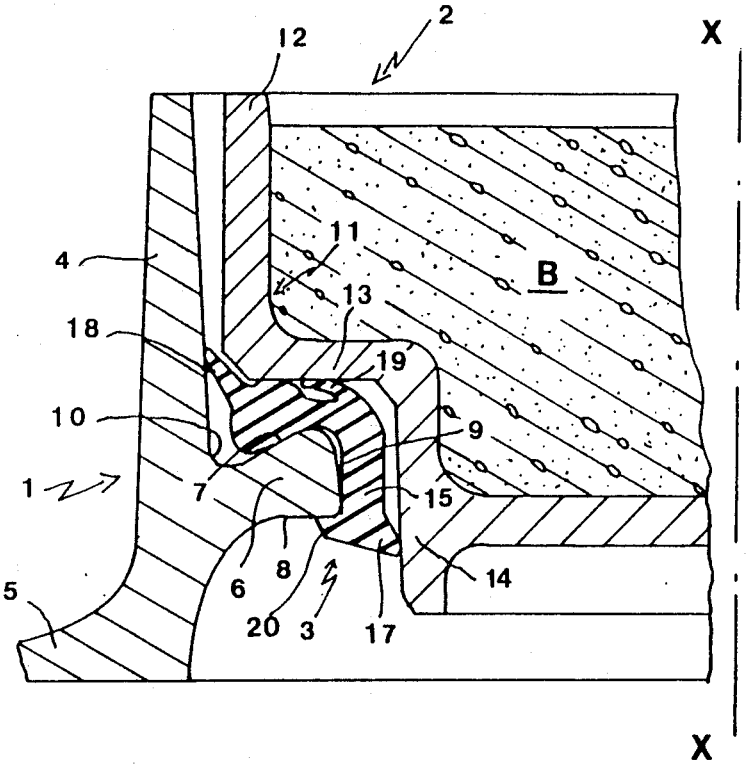
FIG. 1 is a partial view, in axial section, of a roadway manhole equipped with a gasket in accordance with the invention.

Referring to FIG. 1, the roadway manhole includes a cover 2 nested or seated in a frame 1, and a gasket 3 interposed between the cover and the frame. The construction is preferably circular about a vertical axis X—X, but it could also be triangular, rectangular or polygonal in shape.

The frame 1 may be made of nodular graphite iron and comprises a continuous skirt 4 extending vertically upwards from a horizontal bearing flange 5 which rests on the top of a shaft (not shown) forming the manhole. A radial collar 6 extends inwardly at the approximate lower third of the skirt, and defines upper and lower faces 7, 8 joined by an inner surface 9 having a slight conicity converging towards the bottom of the frame. The upper face 7 is frustoconical and converges towards the top of the frame, forming an acute angle with the inner surface or face 9 and being joined to the skirt 4 by a fillet 10.

The cover 2 comprises a bowl-shaped structure 11 made of nodular graphite iron and filled with concrete B. It includes a cylindrical upper skirt 12 having an outside diameter less than the inner diameter of the frame skirt 4 but greater than the inner diameter of the frame collar 6. The cover skirt 12 is extended at its lower end by a horizontal bearing surface 13 located at the mid-height of the cover and joining the upper skirt to a lower skirt 14 having an outside diameter less than the inner diameter of the collar 6.

The gasket 3 of the invention is made of an elastomer having a hardness of between 70° Shore and 85° Shore, is circular about the axis X—X, is closed, and has a constant cross-section. It comprises vertical and horizontal branches 15, 16 provided with upper lips 18, 19 and lower lips 17, 20.

Figure 2:
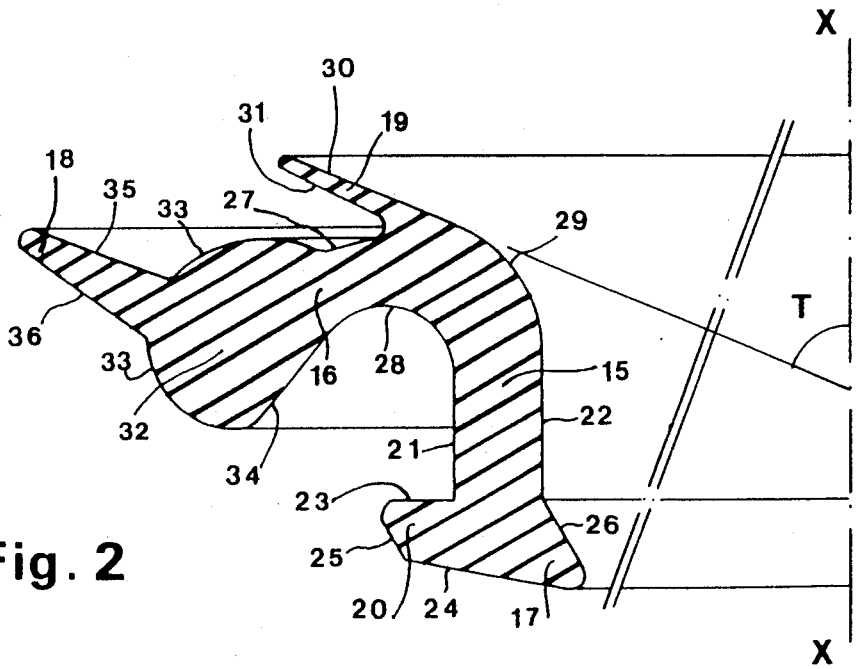
FIG. 2 is an axial section, on a larger scale, of the gasket in its free or unloaded state.

As shown in FIG. 2, the vertical branch 15 defines an outer cylindrical surface 21 having a diameter d1 and an inner cylindrical surface 22 having a diameter d2. The branch 15 is extended at its bottom by an outer lip 20 and an inner lip 17. The approximately horizontal outer lip defines a plane or slightly curved upper face 23 and a lower frustoconical face 24 joined by a further frustoconical face 25 converging towards the base of the gasket. The surfaces 21 and 23 are approximately perpendicular. The inner lip 17 has a frustoconical upper face 26 converging downwardly and extending the cylindrical surface 22, and rounding or merging into the surface 24. The angles of the surfaces 24 and 26 relative to the axis X—X are such that the lip 17 tapers towards its end.

The vertical branch 15 is extended at its upper end by a radially outwardly directed, substantially horizontal branch 16 having an upper frustoconical face 27 and a lower curved face 28, the upper face 27 converging towards the top of the gasket. The lower face 28 directly adjoins the outer cylindrical surface 21 of the branch 15, and the upper face 27 adjoins the inner cylindrical surface 22 of the vertical branch via the lip 19 and a curved surface 29. The upper frustoconical face 30 of the lip 19 is tangent to the curved surface 29 and forms an angle T with the axis X—X of about 75°. The lower face 31 of the lip forms a slightly smaller axial angle, thus imparting a slight taper to th lip.

In the radially outward direction the faces 27 and 28 of the horizontal branch 16 are extended by a bead 32 defining a curved upper and side face 33 and an upwardly converging frustoconical lower face 34. The tapered lip 18 extends upwardly and outwardly from the curved face 33 of the bead, and defines downwardly converging frustoconical surfaces 35 and 36. The upper surface 35 of the lip 18 is substantially parallel to the upper surface 30 of the lip 19.

Referring back to FIG. 1, the inner diameter of the frame skirt 4 is less than the outer diameter of the lip 18 of the unloaded gasket and greater than the outer diameter of the bead 32. The outer diameter of the cover skirt 14 is less than the diameter d2 of the gasket surface 22 but greater than the inner diameter of the gasket lip 17, and the diameter d1 of the gasket surface 21 is less than or equal to the inner diameter of the frame collar 6. Finally, the angle of the gasket surface 34 to the axis X—X is less than the angle between the upper surface 7 of the frame collar and the axis.

With such a construction or configuration, when the gasket 3 is fitted onto the frame by pushing it down over the radial collar 6, the lower bead surface 34 engages the upper collar surface 7 and the upper ledge or shoulder surface 23 of the lower lip 20 hooks under the lower collar surface 8. The horizontal branch 16 of the gasket thus bends or deforms upwardly at its neck portion between surfaces 27 and 28, with the bead 32 rising, the angle between surfaces 34 and 21 becoming larger, and the surface 27 curving. The lip 18 is thus no longer parallel to the lip 19, and is disposed in sealing contact with the inner surface of the frame skirt 4.

Once the gasket has been so installed, the cover 2 is lowered into the frame 1 and onto the gasket, which compresses the bead 32 and bends the lip 19 into sealing contact with the bearing surface 13 of the cover. The lower lip 20 forms a barrier seal with the frame collar 6, and the lower lip 17 forms a final barrier seal with the cover skirt 14. Since the deformation of the lip 17 causes an increase in the pressure exerted by the faces 21 and 23 of the gasket against the faces 9 and 8 of the frame collar, the integrity of the seal is further enhanced in this region. The gasket of the invention thus establishes a tight and sustained seal between the manhole frame and its cover, while at the same time experiencing no appreciable deterioration and damage due to vehicle induced movements of the cover relative to the frame.

What is claimed is:

1. An unlocked roadway manhole assembly, comprising:

(a) a frame (1) defining a generally horizontally oriented, continuous closed figure having a generally vertical axis (X—X) and a radially inwardly extending frame collar (6), (b) a cover (2) configured to be seated within the frame, and (c) a continuous, closed figure sealing gasket (3) interposed between the frame and the cover, disposed in a generally horizontal plane when interposed therebetween, and comprising:

(1) a vertical branch (15) extending around the vertical axis of the frame, (2) a generally horizontal branch (16) extending radially outwardly from an upper end of the vertical branch and disposed between a bearing surface (13) of the cover and an upper surface (7) of the frame collar, and (3) a first pair of spaced frustoconical lips (18,19) having conicities converging towards a lower, base portion of the gasket and extending upwardly and radially outwardly from an upper surface of the horizontal branch.

2. A manhole assembly according to claim 1, wherein the gasket lips each form an angle of between 70° and 80° with said vertical frame axis.

3. A manhole assembly according to claim 1, wherein a radially inward, neck portion of the horizontal branch of the gasket defines upper and lower frustoconical surfaces (27, 34) having conicities converging towards the upper end of the vertical branch of the gasket, and a radially outward portion of the horizontal branch defines an enlarged circular bead (32).

4. A manhole assembly according to claim 3, wherein an outermost one of the lips (18) extends from the bead, and an upper surface (30) of an innermost one of the lips (19) extends tangentially from a curved surface (29) joining the vertical and horizontal branches of the gasket.

5. A manhole assembly according to claim 3, further comprising a second pair of spaced lips (17, 20) respectively extending inwardly and outwardly from a lower end of the vertical branch.

6. A manhole assembly according to claim 4, further comprising a second pair of spaced lips (17, 20) respectively extending inwardly and outwardly from a lower end of the vertical branch.

7. A manhole assembly according to claim 5, wherein the lips of said first and second pair taper towards their outer ends.

* * * * *